United States Patent [19]

Schmidt

[11] Patent Number: 4,664,310

[45] Date of Patent: May 12, 1987

[54] BLANK FOR PARALLELEPIPEDAL BOXES OR BOX ELEMENTS

[76] Inventor: Lothar-Werner Schmidt, Färberstrasse 43, 8900 Augsburg-Pfersee, Fed. Rep. of Germany

[21] Appl. No.: 705,468

[22] PCT Filed: Jun. 4, 1984

[86] PCT No.: PCT/DE84/00126

§ 371 Date: Apr. 19, 1985

§ 102(e) Date: Apr. 19, 1985

[87] PCT Pub. No.: WO84/04907

PCT Pub. Date: Dec. 20, 1984

[30] Foreign Application Priority Data

Jun. 4, 1983 [DE] Fed. Rep. of Germany ... 8316646[U]
Mar. 16, 1984 [DE] Fed. Rep. of Germany ..... 3410217

[51] Int. Cl.[4] ..... A24F 15/00; B65D 85/10

[52] U.S. Cl. ..... 229/87 C; 206/254; 206/255; 206/628; 206/804; 221/260; 221/279

[58] Field of Search ..... 221/87, 88, 247, 260, 221/279; 206/249, 254, 255, 273, 804, 628; 229/87 C, 44 CB

[56] References Cited

U.S. PATENT DOCUMENTS

| | | | |
|---|---|---|---|
| 2,047,090 | 7/1936 | Woolfson | 206/254 |
| 2,801,769 | 8/1957 | Will | 221/260 |
| 3,107,817 | 10/1963 | Hoglund | 221/260 |
| 3,108,711 | 10/1963 | Anton | 221/260 |
| 3,379,364 | 4/1968 | Pilger | 206/628 |
| 3,533,550 | 10/1970 | Benzon-Petersen | 206/273 |

FOREIGN PATENT DOCUMENTS

| | | | |
|---|---|---|---|
| 52154 | 9/1936 | Denmark | 221/260 |
| 7423 | 2/1980 | European Pat. Off. | 206/273 |
| 676480 | 6/1939 | Fed. Rep. of Germany | 221/260 |
| 1030996 | 6/1953 | France | 206/254 |
| 412655 | 7/1934 | United Kingdom | 221/260 |
| 642831 | 9/1950 | United Kingdom | 229/87 C |

*Primary Examiner*—Stephen P. Garbe
*Assistant Examiner*—Gary E. Elkins
*Attorney, Agent, or Firm*—Wenderoth, Lind & Ponack

[57] ABSTRACT

A blank for forming a parallelepipedal box or a parallelepipedal box element is constructed with a removal strip in such a manner that parallel tear lines extend through three connected wall sections of the blank. The tear lines end in one wall section at an articulation area. The tear lines delimit the removal strip which can be torn out of a finished pack or box and upon which a pulling force can be exerted in such a manner that the removal strip is bent about the articulation area, thus causing objects to be lifted from the box by the removal strip.

10 Claims, 9 Drawing Figures

11
12
10a
19
18
29
17
10
12d
12c
12b
12a
14

BLANK FOR PARALLELEPIPEDAL BOXES OR BOX ELEMENTS

BACKGROUND OF THE INVENTION

The present invention relates to blanks for use in forming parallelpipedal boxes or box elements.

Such a blank can be folded and assembled to form a parallelepipedal box which directly receives objects. Also, such blank can be formed into an inner casing of a box which casing forms a box element which surrounds the objects to be packaged and is located with the objects in an outer box.

When uniform objects, e.g., rod-like or plate-like objects, are closely packed in parallelepipedal boxes with or without an inner casing, problems always occur when the box is opened and the objects are removed. These problems are especially difficult if the fingers are used for removal. The problems become quite severe if the objects are sensitive, particularly if they can be easily damaged and/or if these objects can be damaged or spoiled by dirty hands.

For example, the above-mentioned problems occur in the packaging of cigarettes. Removal aids in the form of removal strips have already been provided for cigarette packages. For example, U.S. Pat. No. 2,935,228 describes a cigarette box within which is positioned a separate removal strip which extends under the objects and which has an end to be grasped by the hand after the box has been opened. When this strip is pulled, one or more cigarettes are removed from the box if the strip is sufficiently rigid. Such technique results in extraordinary problems during the manufacture and the filling of the box, since a separate strip must be inserted in a finishing stage and the position of the strip must then be maintained during the filling of the cigarettes into the box. Thus, special precautions must always be taken during the manufacture and the filling of the boxes, which precautions have a considerable adverse effect on the reliability of the operation and on the speed thereof.

GB 841,314 teaches a blank for the inner casing of a cigarette package. The foil from which the blank is produced is provided prior to the folding of the blank with a strip which is intended to function as a removal strip in the finished cigarette package. It is necessary in this known technique to feed a narrow strip to the foil blank. This narrow strip is fed in an initial stage of the operation at a speed greater than the running speed of the foil. This should cause the strip to extend over the front end edge of the foil in order to form a handhold or tab. Subsequently, the running speed of the strip is adapted to the running speed of the foil and the strip is provided with glue in spots. A section of the strip is then adhered to the foil. The foil is then cut behind the adhered area. Two blank parts are produced from this foil from which an inner casing of the box can be manufactured. This inner casing then comprises a removal strip which is adhered to a side of the inner casing, extends completely under the cigarettes, runs up on the other side of the inner casing and can be grasped from the outside.

It is no longer necessary in this method of operation to provide a removal strip which is completely separate from the box. It is, however, necessary to provide the foil with the separate strip by a complicated operation and to connect the two parts firmly to one another in determined relative position. The method of operation described in the British patent does not permit a continuous manufacture. This attaching of the strip to the foil makes it necessary that the operation be interrupted and that a shift must occur, whereby the strip is initially fed at a speed greater than the speed of the foil. Wasted material is necessarily generated in this known method of operation. This loss of material makes the manufacture more expensive. The application of glue is also not without problems, and the shifting of the feed speed of the strip requires a complicated mechanism.

Other problems occur in the subsequent treatment of this foil provided with a strip, in addition to the problems which result during the manufacture of the foil with a strip. Special precuations must be taken during the folding and assembly of the blank in order to hold the strip in its proper position on the foil at all times. It is absolutely necessary to prevent the strip, which is to function as a removal strip, from folding at any stage of the assembly. Care must be taken when the box is being filled with cigarettes that the strip, which is adhered to the inner casing at only one adhered area, can not be shifted. The assembly of this known blank to an inner casing entails many problems.

SUMMARY OF THE INVENTION

The object of the invention is to create a blank both for an outer box and also for an inner casing of a box, which blank already includes a removal strip the manufacture and handling of which facilitates assembly of the blank into a box or a box element, and which permits filling of the box or box element without problems and at a high speed.

It is especially advantageous if the removal strip is constructed as an integral component of the blank. All that is required for this is to form special tear lines in the blank. Such a method of operation can be performed without problems. The manufacture of the blank can occur in a very simple manner using techniques which are quite easy to control. This makes the method of manufacture of the blank considerably more economical and substantially increases the speed of manufacture.

Since the strip is not separate from the blank or connected thereto solely at one point, the further handling of the blank presents absolutely no problems. Such a blank is easy to stack and store. Blanks with strips hanging therefrom pose problems from the very start, since stacking and storage must be carefully executed in order to prevent folds from forming in the strips.

When the blank is assembled to an outer box or to a box element forming an inner casing of a box, simple techniques can be used, since the blank is completely smooth and has no parts hanging or extending therefrom. No care need be taken to ensure that the removal strip maintains its predetermined position when the box is assembled.

Filling such a box or inner casing is likewise completely without problems, since no parts separate from the box or the box element have to be held in their correct position by special precautions.

Such a blank can be used not only for packaging cigarettes but also for packaging any type of rod-like or plate-like objects.

The tear lines which delimit the removal strip and along which the removal strip can be torn from the blank during use end in an articulation or connection area or portion of the removal strip. This articulation portion is a point about which the removal strip is bent during withdrawal and at which precautions can be taken in a known manner to prevent the tear lines from tearing further. The position of this articulation portion in the wall section of the blank determines the lift height by which an object can be lifted from the box or box element. The tear lines can start at any point within one of two main wall sections of the blank, and perforations can be provided therein, for example, in order to be able to grasp the removal strip. However, the tear lines intersect the edge of this wall section in an advantageous manner.

After the first object or objects have been lifted from the box, the density of the objects in the box is reduced such that removal of subsequent objects occurs without problems. In this instance the removal strip would not have to be used any further. It is therefore advantageous if the articulation portion for the removal strip can be torn. It is particularly advantageous if the force required for such tearing is greater than the force required to tear the removal strip from tha blank along its tear lines. A vigorous jerk on the removal strip is required after the raising of the first object and after its removal to remove the removal strip.

In a preffered embodiment, the blank includes another wall section through which the tear lines extend. This further wall section then forms a wall in the assembled blank which is located opposite the wall formed by a wall section between the two main wall sections. These two walls can be, for example, a bottom wall and a cover or top wall.

In another geometric configuration of the blank in which, for example, the front and the back side of a box or of a box element can be folded about a side edge, a third wall section, which forms the bottom, for example, can consist of two separate parts. The parts of the removal strip then includes adhesive or glued areas by means of which the separate parts of the removal strip are permanently connected to each other.

The removal strip can have a grip or tab for easier removal. This grip can be a part of the blank itself which can be torn out. This simplifies the manufacture of the blank and the opening of the box or of the box element, and the raising of the objects is simplified by the fact that only a single manipulation is required.

It is also possible for the hand grip to be a part of the box or box element separate from the blank, such part being permanently connected to the removal strip, e.g., by an adhesive spot.

The tear lines can be curved or straight lines. They can diverge or converge either entirely or in part. Convergent—divergent sections can also be provided, especially under the objects. A zig-zag form is also possible. In particular, the fold lines can run parallel to each other.

A versatile geometric form of the blank is formed if the tear lines run transversely of to the fold lines between the wall sections through which the tear lines extend. In this instance the tear lines run parallel to the side edges of the blank. Within the width of the blank the tear lines can be located in the middle or to the side, depending on the intended use of the box or box element.

If, for example, the blank is intended for a box element such as, for example, an inner casing of a box, it can be advantageous to adhere the inner casing to the outer box in such a manner that the removal strip can be torn out without problems. In particular, it should be assured when the removal strip is removed that the inner casing remains in the box and is not pulled therefrom by pulling on the removal strip. In this instance it is advantageous if the blank has adhered spots, e.g., glued spots adjacent to the tear lines.

It is particularly advantageous if the third wall section forms a bottom of the box or box element after the blank has been assembled. In this instance the two other wall sections, through which the removal strip extends, form side walls, e.g. front and back walls.

The construction can also be such that the removal strip is not pulled up, but rather is arranged in such a manner that, when the box opening is on the side, the strip runs transversely, that is, parallel to the bottom.

It is also advantageous if the blank is provided as an inner casing of a box which casing completely surrounds the objects and includes an upper part which can be torn off along a tear line in order to expose the upper ends of the objects. The removable part of the inner casing can be integral with the removal strip. This has the advantageous result that when the upper part of the inner casing is removed with the removal strip, at least one of the objects is automatically pushed up before the removable part with the removal strip is completely removed from the box. It is possible, for example, after opening the box in the customary manner, to easily grasp a cigarette in a cigarette pack by the mouthpiece and completely pull it out.

The tear lines can be produced in accordance with a customary technique known in the packaging art. In particular, webs can be formed between the removal strip and the remainder of the blank in the area of the tear lines, the number and widths of such webs being determined in accordance with the tear force desired.

The width of the removal strip, that is, the distance between the tear lines, is dimensioned, for example, in accordance with the width of a predetermined number of adjacent, rodlike objects to be removed when the removal strip is torn.

BRIEF DESCRIPTION OF THE DRAWINGS

The invention is explained below with reference to the accompanying drawings.

DETAILED DESCRIPTION OF THE INVENTION

Figure 1:
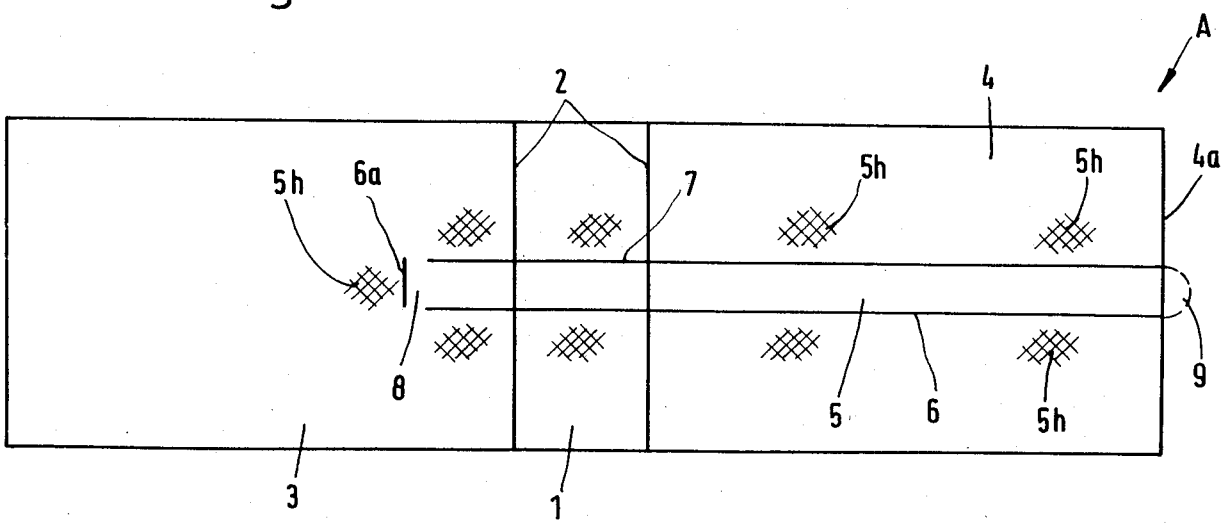
FIG. 1 is a plan view of a blank showing only essential elements according to the invention.

FIG. 1 shows the essential elements of a blank A for forming a box or box-shaped element. From such a blank can be produced a box which directly receives objects, with sections or panels for side walls and a top or cover wall being omitted. It is also possible to produce from this blank a box element which forms an inner casing located in an outer box.

The blank A shown in FIG. 1 comprises wall section 1 connected to other wall sections 3, 4 via fold lines 2. Wall sections 3, 4 form walls which are located opposite one another in the assembled state of blank A and which are separated by wall section 1. Wall section 1 can form a bottom section, for example, of a box. Wall sections 3, 4 then form the front and back sides of the box or box element. It is also possible for wall section 1 to form a side wall in the assembled state of blank A, whereby wall sections 3, 4 again form front and back sides. In this instance the box openings can be located not at the top but rather at a side of the box.

As FIG. 1 shows, two parallel tear lines 6, 7 run from edge 4*a* of wall section 4 through wall section 4, across one fold line 2, through wall section 1, cross the other fold line 2 between wall section 1 and wall section 3 and into wall section 3 at a predetermined distance from the other fold line 2 between wall section 3 and wall section 1. These tear lines 6,7 delimit a removal strip 5 which can be torn out and removed from a box formed by the blank. Removal strip 5 ends in wall section 3 at an articulation portion 8 for removal strip 5. Removal strip 5 can include a tab or grip 9.

When blank A shown in FIG. 1 is assembled with wall section 1 forming a bottom section, objects can stand on the bottom section in the box formed by blank A. These objects can be rod-shaped, like cigarettes, for example. When the box is to be opened, grip 9 can be grapsed and removal strip 5 can be torn along tear lines 6, 7 from wall sections 1, 3 4 by a pulling motion, and then bent upwardly about articulation portion 8. This action raises objects upwardly from the box.

Articulation portion 8 can also be torn out. For example, another tear lines, as indicated at 6*a*, can be provided in the vicinity of articulation portion 8. Tear line 6*a* is constructed in such a manner that the force required to tear out articulation portion 8 is greater than that which must be exerted to tear along tear lines 6, 7.

If blank A shown in FIG. 1 is used for the production of a box element, e.g. an inner casing, which is placed in an outer box, adhesive spots 5*h* can be provided adjacent to tear lines 6,7, that is, adjacent to removal strip 5. These adhesive spots 5*h* can be glued spots and the assembled blank A can then be adhered to the outer box or pack by adhesive spots 5*h*. This makes it possible to tear out removal strip 5 without problems.

Figure 2:
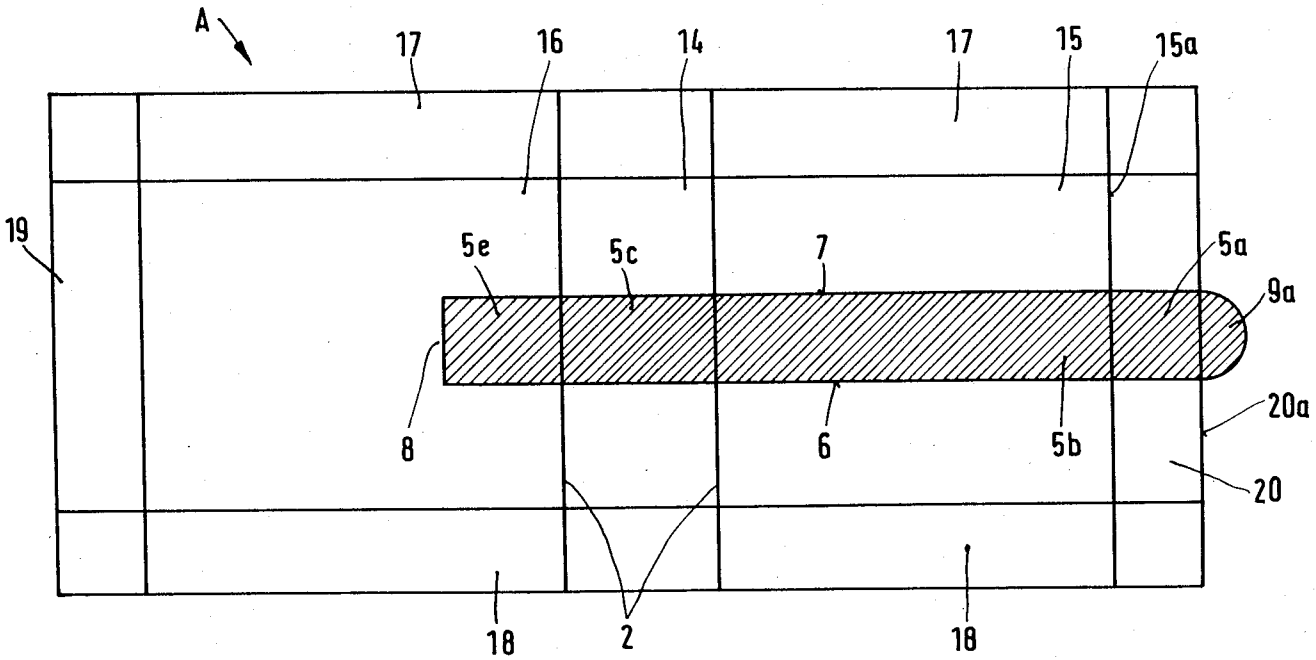
FIG. 2 is a plan view of a blank for a parallelepipedal box element.

FIG. 2 shows a blank A from which a parallelepipedal box or a parallelepipedal box element can be produced. The material of this blank A can be tin foil. This blank A comprises a wall section 14, a front wall section 15, a back wall section 16 and associated side sections 17, 18 which are laid over one another in a folded state. A wall section 19, which forms a back top, and wall section 20, which forms a front top, are placed over one another as overlapping sections in the assembled state of the box in such a manner that the upper ends of the objects in the box are completely covered. Tear lines 6, 7 are constructed in such a manner that removal strip 5 comprises a part 5*a* which extends through wall section 20, a part 5*b* which extends through front wall section 15, a part 5*b* which extends through wall section 14 and part 5*e* which extends into back wall section 16. Grip or tab 9 is for grasping removal strip 5.

Figure 3:
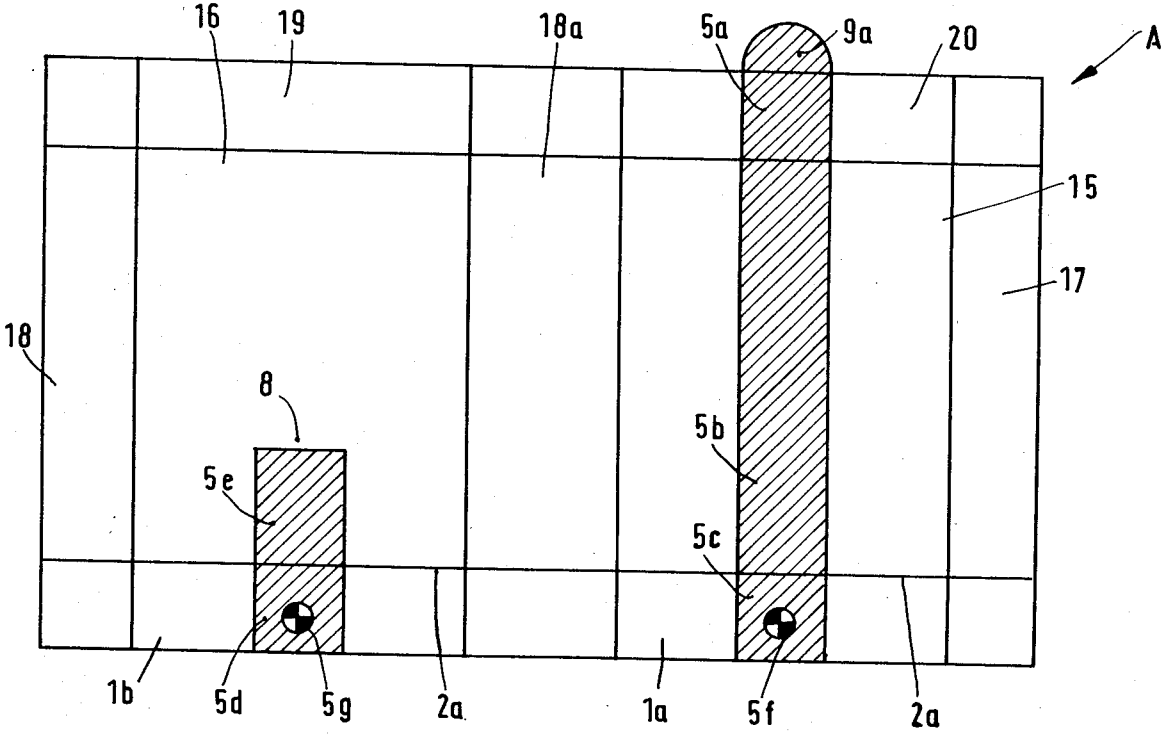
FIG. 3 is a plan view of a blank with a different gemmetry.

FIG. 3 shows a blank A with another geometry. Front and back wall section 15, 16 are again provided. However, a wall section 14 forming the bottom is not located directly between front and back wall sections 15, 16, but rather a side section 18*a* is located therebetween.

The bottom section is bipartite and comprises wall sections 1*a*, 1*b* which are connected to the associated wall sections 15, 16 by fold lines 2*a*. Removal strip 5 is multipartite and includes connected parts 4*a*, 5*b*, 5*c* and connected parts 5*d*, 5*e*, with parts 5*d*, 5*c* in wall sections 1*b*, 1*a* of blank A having adhesive spots 5*f*, 5*g*, e.g. glued spots. Multipartite removal strip 5 can be connected as a unit by means of adhesive spots 5*f*, 5*g* during assembly or after the assembly of blank A.

Figure 4:
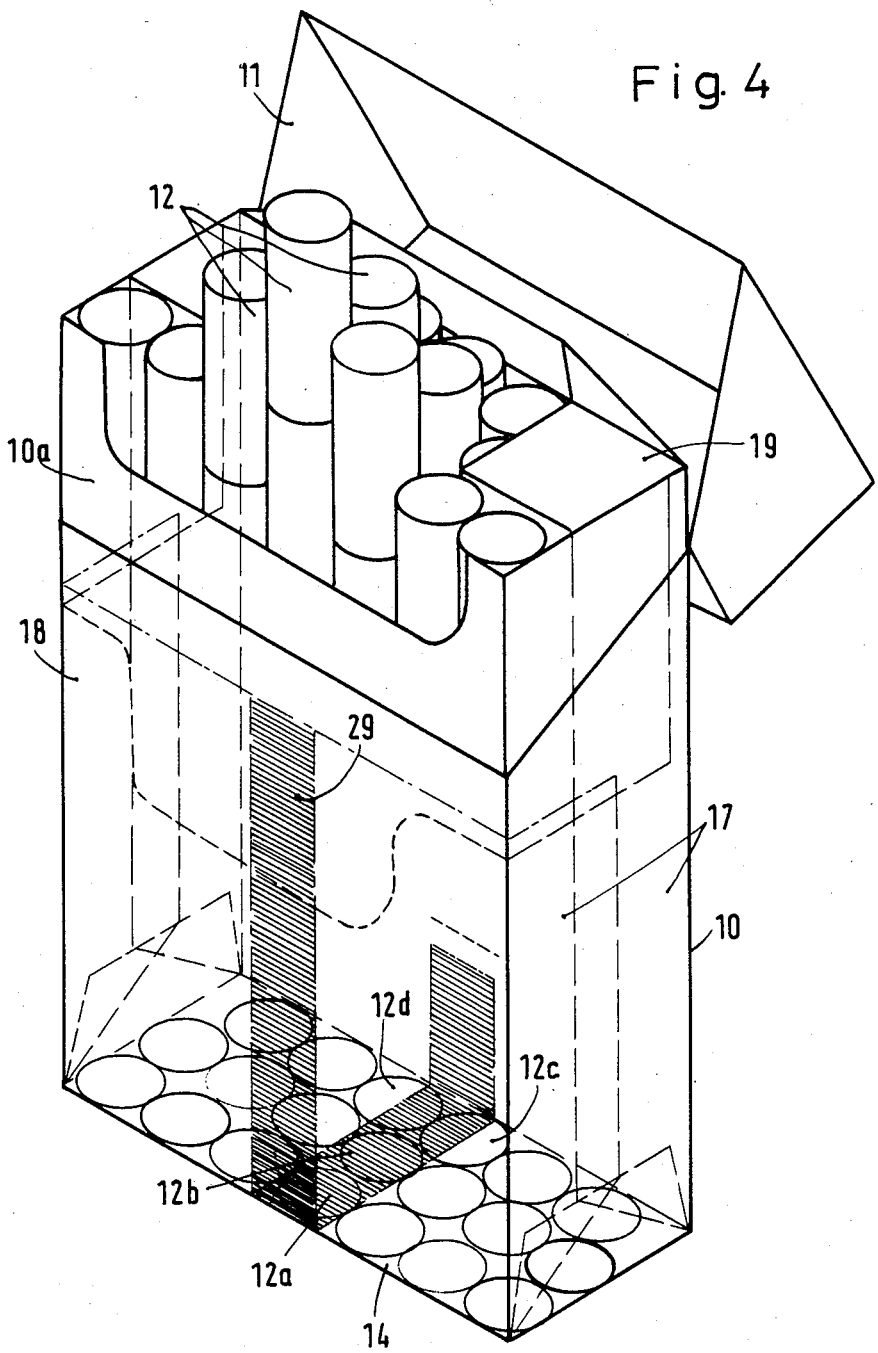
FIG. 4 is a perspective view of a cigarette pack formed as a hand pack with folded-back cover and pulled-out front top part, whereby center cigarettes are shown raised in relation to the remaining cigarettes.
Figure 5:
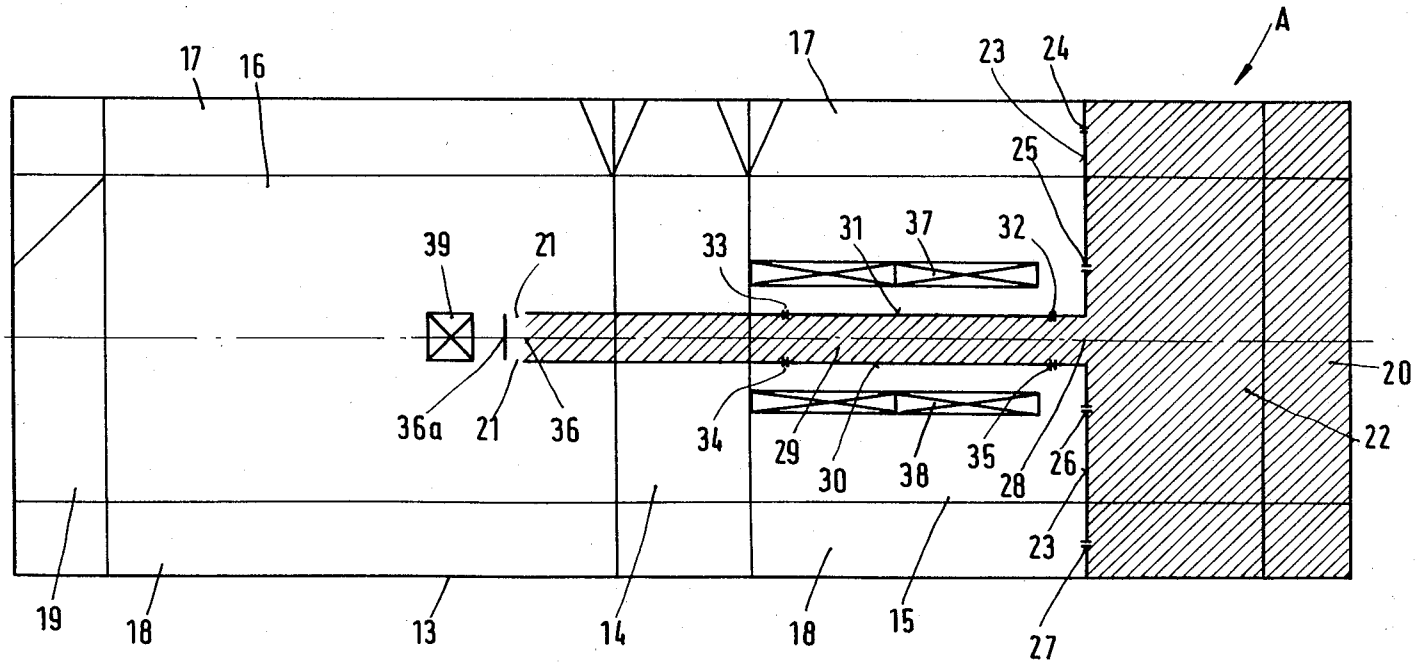
FIG. 5 is a plan view of a tin-foil blank for the cigarette pack of FIG. 4.

FIG. 4 shows a hard pack 10 including a lift-up lid 11 shown open to expose a collar insert 10*a*. Several cigarettes 12 are shown in thrust-forward or partially removed position. An inner casing is shown as a box element which surrounds cigarettes 12 and is constituted by tin-foil wrapping cover 13, whose blank is shown in FIG. 5. Such a tin-foil blank is coated with paper and is formed from a glue-coated aluminum foil. After the blank has been assembled, the paper coating faces inward. This blank comprises a wall section 14 which forms the bottom of the inner casing, a wall section 15 which forms a front wall and a wall section 16 which forms a back wall. Side sections 17, 18 are folded over one another and form side walls. Wall sections 19, 20 overlap one another in the closed state of the box with wall section 20 positioned outwardly.

Removal top 22 is shown in FIG. 5 and is delimited by tear lines 23. The tin-foil blank is partially cut through along tear lines 23. The connection between removable top 22 and front wall section 15 consists of four webs 24,25,26,27. The width and the number of the webs determine, as a function of the strength of the material selected, the force required to tear off removable top 22 from front wall section 15. This force is selected in such a manner that removable top 22 can be torn off without pulling out the rest of tin-foil wrapping cover 13. Tin-foil wrapping cover 13 can be fastened in the outer packing case by glued spots 37,38,39. Removal strip 29 begins at 28 at removable top 22 and is integral therewith. Removal strip 29 extends through front wall section 15 and wall section 14 forming the bottom into wall section 16, which forms the back wall in the assembled state. This removal strip 29 is formed in blank A by tear lines 30,31 which extend through the appropriate wall sections. In the embodiment shown these tear lines 30,31 are formed by cuts and webs 32,33,34,35 located in front wall section 15. The cuts extend entirely through wall section 14 and the respective portion of back wall section 16. Removal strip 29 ends at articulation portion 36 in back wall section 16. Articulation portion 36 can be torn off and includes webs 21 and tear line 36*a*. The width of webs 32–35 and of webs 21 determine the tear forces required. The tear forces are determined so that the force required to tear off articulation portion 36 is greater than that required to tear off webs 32–35.

Tin-foil wrapping cover 13 is fastened in the outer packing case by the three glued spots 37,38,39.

When removal strip 29 is pulled out, it is pivoted about articulation spot 36 in such a manner that underlying cigarettes 12 are caught thereby and pushed up for removal. Glued spots 37,38,39 hold tin-foil wrapping cover 13 in place. The number of cigarettes 12 directly pushed out be removal strip 29 is a function of the width of removal strip 29. After the first cigarettes 12 have been removed, removal strip 29 can be torn off.

When removal strip 29 is pulled out, cigarettes 12*d*, 12*c* adjacent to removal strip 29 (FIG. 4) can also be carried along therewith by friction contact. After removal strip 29 has been torn off, the density of the pact is loosened to such an extent that it is easy to remove the rest of cigarettes 12.

Figure 6:
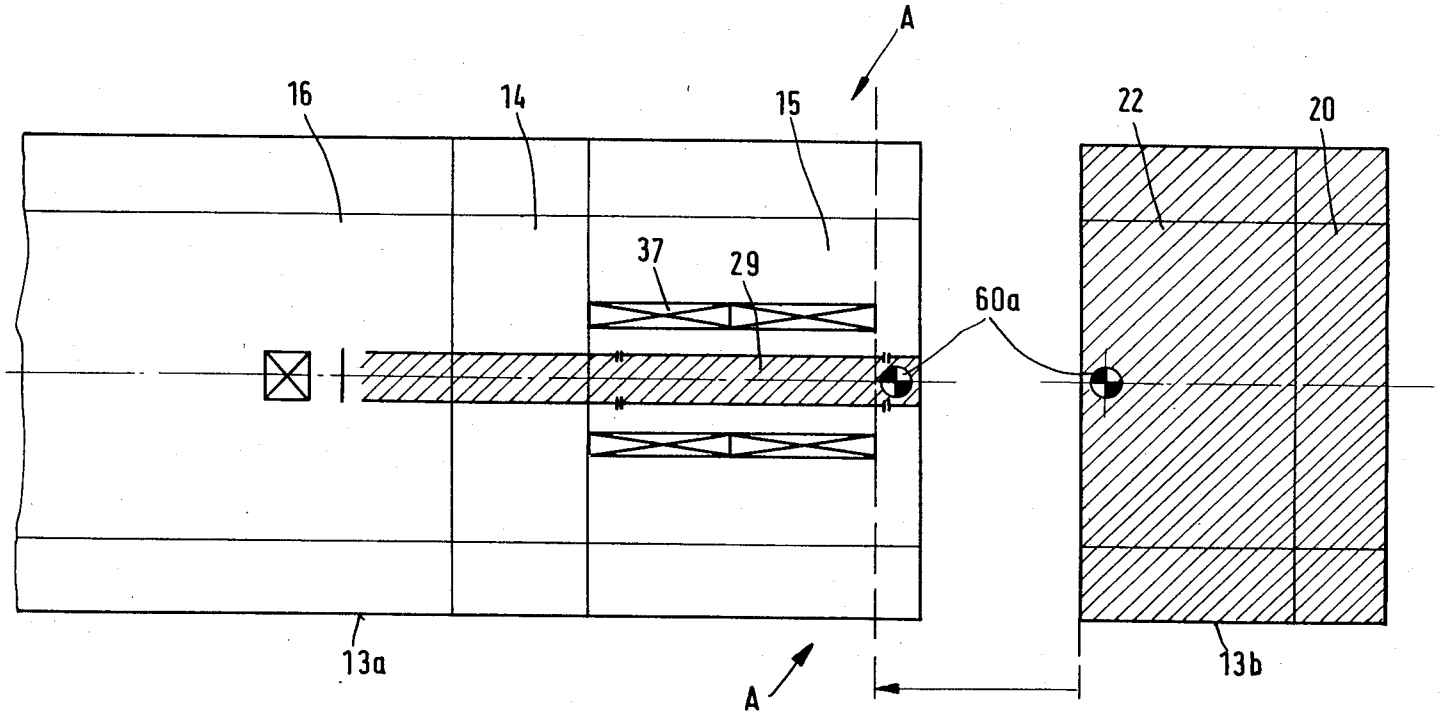
FIG. 6 is a plan view of a modified tin-foil blank for such cigarette pack.

In the case of the tin-foil wrapping cover 13 shown in FIG. 6, shaded removable top 22 is constructed as a separate blank 13*b*. Glued spots 60*a* are provided at the end of removal strip 29 and on separate blank 13*b* in order to connect these parts.

Figure 7:
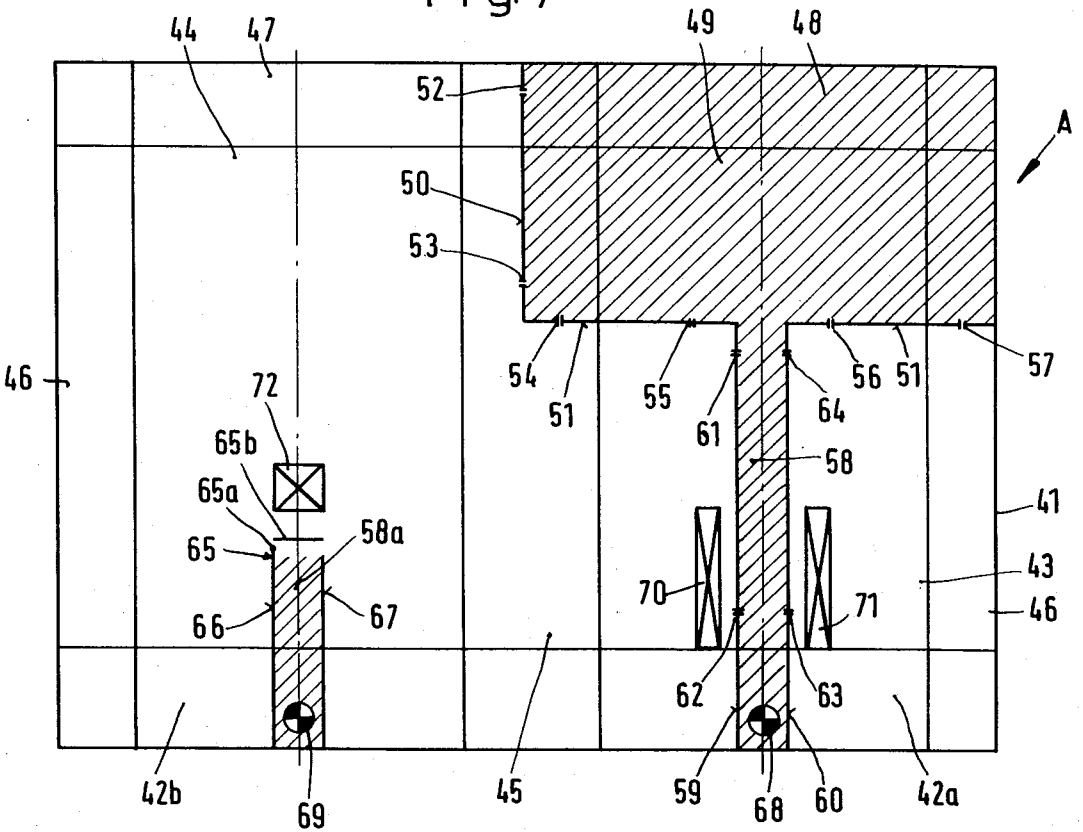
FIG. 7 is a plan view of another tin-foil blank for a cigarette pack.

FIG. 7 shows a tin-foil blank 41 whose geometry is rotated by 90° in relation to the geometry of the tin-foil blank shown in FIG. 5. Wall sections 47,48 as well as 42*a*,42*b*,45 of this tin-foil blank 41 overlap each other in the assembled and folded state. Wall sections 42*a*,42*b* form the bottom. Wall section 43 forms the front wall, wall section 44 forms the back, wall and wall section 45 forms a side wall. Wall sections 46 then form the opposite side wall. Removable top 49 is a part of front wall section 43 and of wall sections 46,45 and also comprises wall section 48. Removable top 49 is delimited by tear lines 50,51, which are cut lines with webs 52–57.

Removal strip 58 is delimited by tear lines 59,60 and is integral with removable top 49. Tear lines 59,60 are cut lines with webs 61–64. Tear lines 59,60 extend through wall section 42*a*. Separate tear lines 66,67 are formed in wall section 42*b* and in wall section 44 and define section 58*a* of removal strip 58. Removal strip section 58*a* ends at an articulation area formed by tear line 65*b* and webs 65*a*. Glued spots 68,69 are provided to produce a unitary removal strip 58 and make a unit of the sections of removal strip 58 during assembly and folding operations. The tin-foil wrapping cover can be fixed in an outer casing by glued spots 70–72.

Figure 8:
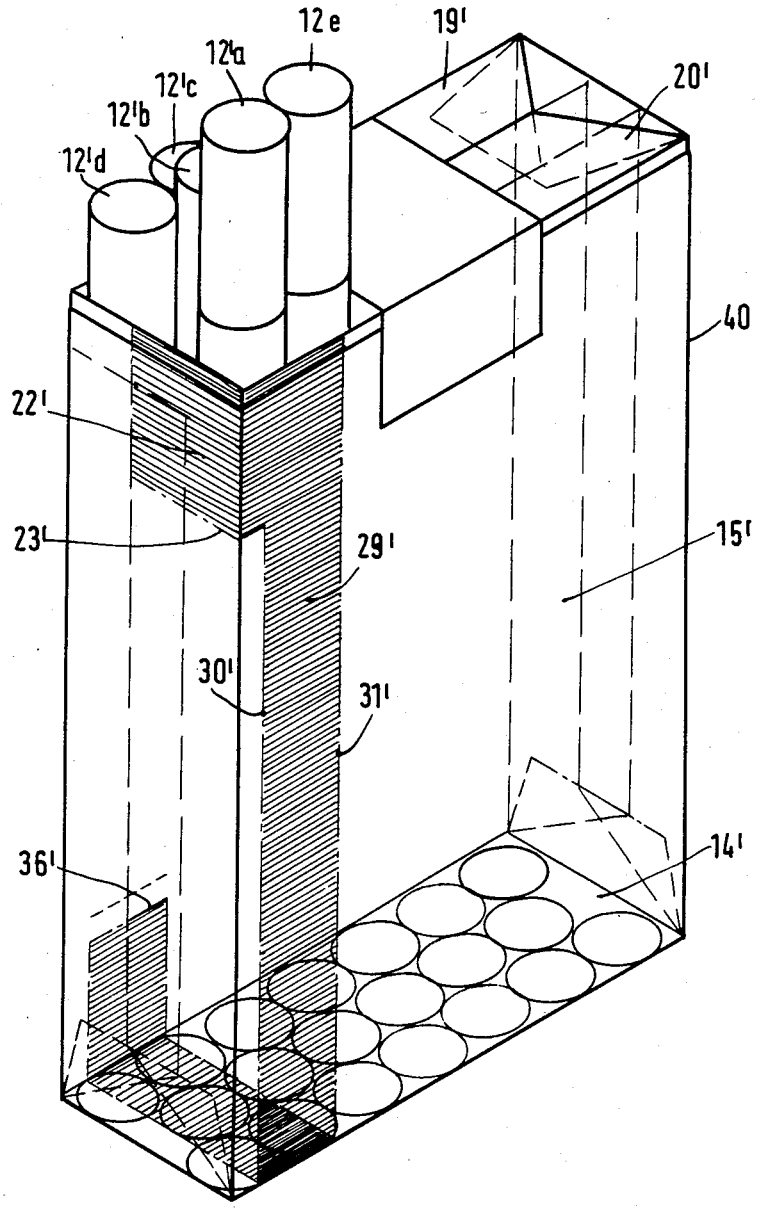
FIG. 8 is a perspective view of a soft pack with raised cigarettes.

FIG. 8 shows a so-called soft pack 40 from which the cigarettes 12 on one side thereof are removed. The central part of the top of the soft pack is closed by a sealing strip, e.g. the revenue stamp.

Figure 9:
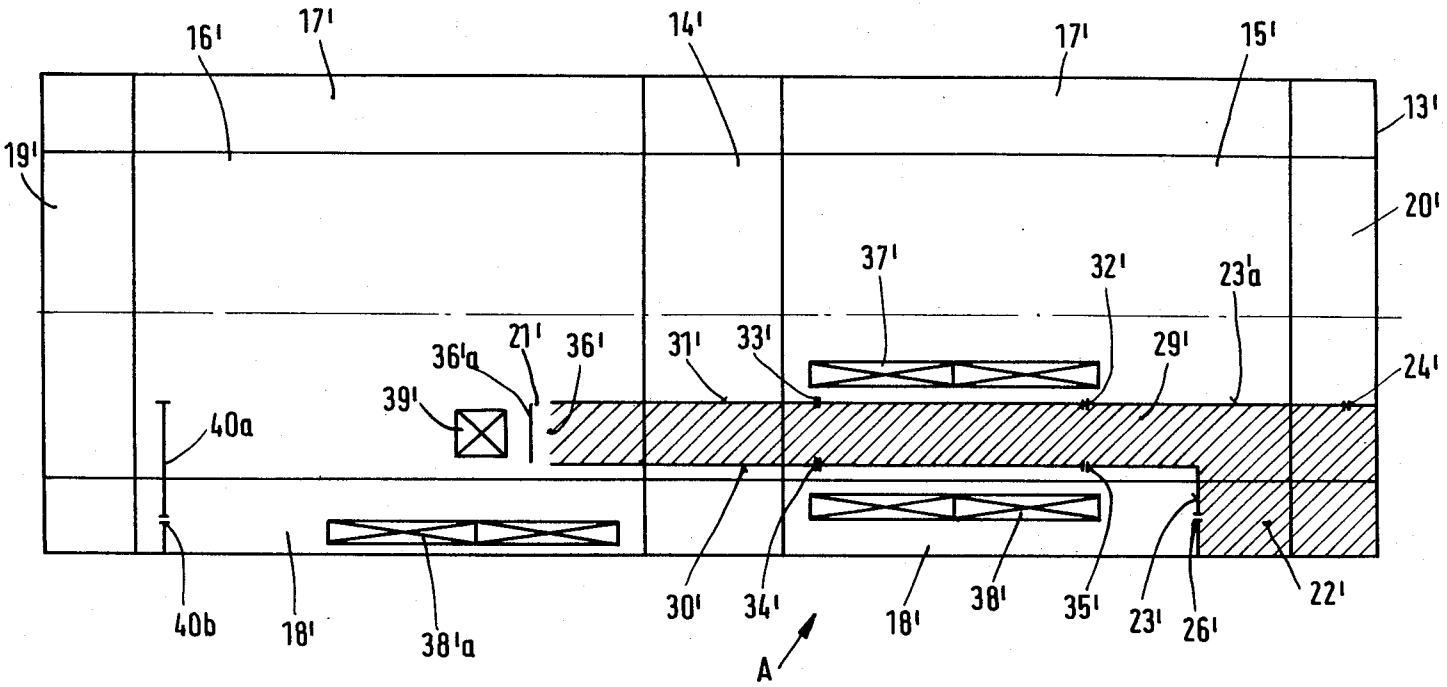
FIG. 9 is a plan view of a tin-foil blank for the soft pack of FIG. 8.

FIG. 9 shows a tin-foil wrapping cover 13' used as an inner casing in soft pack 40. This tin-foil wrapping cover 13' comprises wall section 41' which forms the bottom, wall section 15' which forms the front wall and wall section 16' which forms the back wall. Wall sections 17',18' are provided and form the side walls. Wall sections 19',20' are also provided to form the upper closure. As concerns its walls, tin-foil wrapping cover 13' corresponds in geometry to the tin-foil wrapping cover shown in FIG. 5.

Removable top 22' is provided in a corner area of tin-foil wrapping cover 13' and is delimited by tear line 23' which includes a cut with a web 26'. Another cut with a web 24' is provided in wall section 20' in order to also delimit removable top 22'.

Removable top 22' is integral with removal strip 29' which extends through wall sections 15',14' and into wall section 16'. Articulation portion 36', which can be torn off, comprises tear line 36'*a* and webs 21'. Glued spots 37',38',38'*a*,39' are provided. Another cut line 40*a* with web 40*b* extends, as shown, through wall section 18' of tin-foil wrapping cover 13' and into wall section 16'.

It is obvious that this construction makes it possible to use the principle of a removal strip integral with the blank in a box from a corner of which objects are removed.

In another embodiment (not shown) the removable top and the removal strip are connected in such a manner that when sufficient force is applied to the top, this connection is broken after the cigarettes in the vicinity of the removal strip have been pushed out by the strip being pulled out. The removal strip remains in the opened box, since its articulation portion is stronger than the connection to the removable top. The removal strip is pushed back into the box when the displaced cigarettes not removed are pushed back into the box.

In another embodiment the lift-up lid 11 of hard pack 10 can be connected to the adjacent end of the removal strip. In order that the removal strip does not prevent the pushed-forward cigarettes from being removed, the upper end of the removal strip is shaped like a fork in the area of the removable top. When lift-off lid 11 is raised, the removal strip is lifted. The removable top is provided with tear lines shaped in such a manner that when lift-off lid 11 is raised, the pushed-forward cigarettes go through the removable top, so that they are available.

I claim:

1. A blank adapted to be assembled, by folding along fold lines, into a parallelepipedal box or box element to be filled with a plurality of uniformly shaped rod-like or plate-like objects having a removal member for facilitating removal of at least an initial object from the formed box or box element, said blank comprising:

first and second sections adapted to form, upon assembly by folding along predetermined fold lines, first and second spaced opposite walls of the box or box element;

a third section adapted to form, upon said assembly, a third wall located between and connecting said first and second walls, such that objects may be positioned parallelly between said first and second walls with ends of the objects abutting said third wall;

first and second parallel, rectilinear tear lines formed in said blank to extend through said first and third sections and into said second section, said tear lines defining therebetween a removal strip which can be torn from said blank and which has a removable first end at said first section and a second end within said second section and joined thereto by an articulation portion, whereby, upon said assembly, pulling of said first end of said removal strip longitudinally in a direction parallel to said tear lines and away from said third section will result in said removal strip, with said second end thereof connected to said second section, pulling outwardly an object having an end thereof abutting said removal strip; and means for enabling removal of said second end of said removal strip from said second section by the application to said removal strip of a force greater than the force required to tear said tear lines, thereby tearing said articulation portion, said means comprising a further tear line in said second section at a position spaced from said first and second tear lines.

2. A blank as claimed in claim 1, further comprising a fourth section connected to said first section at a side thereof opposite said third section, and said tear lines extend through said fourth section.

3. A blank as claimed in claim 2, wherein said third section comprises a single part formed integrally between said first and second sections, and said tear lines define a single continuous removal strip.

4. A blank as claimed in claim 2, wherein said third section comprises separate first and second parts formed integrally with said first and second sections, respectively, and said tear lines define a first portion of said removal strip extending through said fourth and first sections and said first part of said third section and a second portion of said removal strip separate from said first portion thereof and extending through said second part of said third section and into said second section, and further comprising adhesive means for, upon said assembly, connecting said first and second portions of said removal strip at said first and second parts of said third section.

5. A blank as claimed in claim 1, further comprising a hand grip portion at said first end of said removal strip.

6. A blank as claimed in claim 5, wherein said hand grip portion is connected to said first section by further tear lines and is integral with said removal strip.

7. A blank as claimed in claim 5, wherein said hand grip portion comprises a member formed separately from said removal strip and connected thereto by adhesive.

8. A blank as claimed in claim 1, further comprising adhesive applied to said blank at positions laterally adjacent said tear lines.

9. A blank as claimed in claim 1, wherein said tear lines extend perpendicularly to fold lines to be formed between said sections upon said assembly.

10. A blank as claimed in claim 1, wherein each said tear line is formed by cuts through said blank, said cuts being interrupted by webs connecting said removal strip to the remainder of said blank, the number and width of said webs determining the force required to tear said removal strip from said remainder of said blank.

* * * * *